United States Patent [19]

Cannon

[11] Patent Number: 4,763,481

[45] Date of Patent: Aug. 16, 1988

[54] COMBUSTOR FOR GAS TURBINE ENGINE

[75] Inventor: Michael F. Cannon, Lincoln, England

[73] Assignee: Ruston Gas Turbines Limited, England

[21] Appl. No.: 870,388

[22] Filed: Jun. 4, 1986

[30] Foreign Application Priority Data

Jun. 7, 1985 [GB] United Kingdom ..... 8514388
Jun. 20, 1985 [GB] United Kingdom ..... 8515658

[51] Int. Cl.[4] ..... F02C 1/00
[52] U.S. Cl. ..... 60/737; 60/746
[58] Field of Search ..... 60/737, 738, 746, 754, 60/748

[56] References Cited

U.S. PATENT DOCUMENTS

| | | | |
|---|---|---|---|
| 2,654,219 | 10/1953 | Zaba | 60/39.65 |
| 3,720,058 | 3/1973 | Collinson et al. | 60/39.74 R |
| 4,004,056 | 1/1977 | Carroll | 60/754 |
| 4,422,300 | 12/1983 | Dierberger et al. | 60/757 |
| 4,525,996 | 7/1985 | Wright et al. | 60/748 |

FOREIGN PATENT DOCUMENTS

| | | |
|---|---|---|
| 0095788 | of 1983 | European Pat. Off. . |
| 1344800 | 1/1974 | United Kingdom . |
| 1559779 | 1/1980 | United Kingdom . |

*Primary Examiner*—Louis J. Casaregola
*Assistant Examiner*—Timothy S. Thorpe
*Attorney, Agent, or Firm*—Kirschstein, Kirschstein, Ottinger & Israel

[57] ABSTRACT

A combustor for a gas turbine engine. The combustor employs an array of fuel injectors arranged across and in the mouth plane of the combustor flame tube. Each injector has a baffle plate through which the injector nozzle projects, the baffle plate having axial holes for atomization air to intercept and atomize radial fuel jets from the injector nozzle. Cooling of the flame tube is performed by full coverage impingement and effusion without disturbing the cooling film by entry and penetration of transverse air jets. Flame stabilization is achieved under all required operating conditions by the radial-fuel/axial-air atomization in conjunction with the baffle plates. Comprehensive combustion mixing and dilution is achieved by the uniformly distributed supply of up to 90% of the total air supplied to the combustor around and through the baffle plates. There is a resultant economy in the air used for cooling, a uniformity of temperature distribution, stability of operation, and minimal emission of oxides of nitrogen.

15 Claims, 6 Drawing Sheets

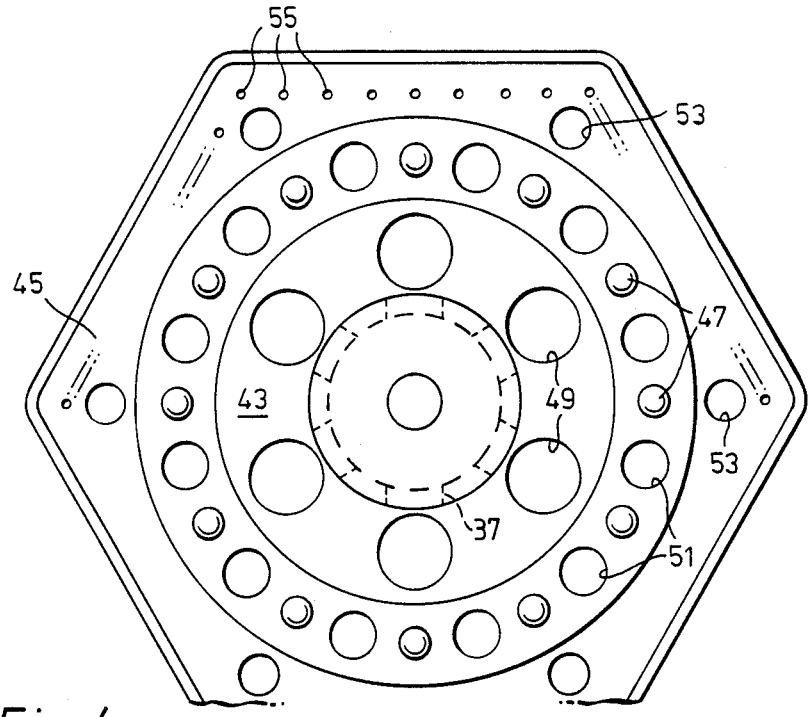
Fig.4.
Fig.5.
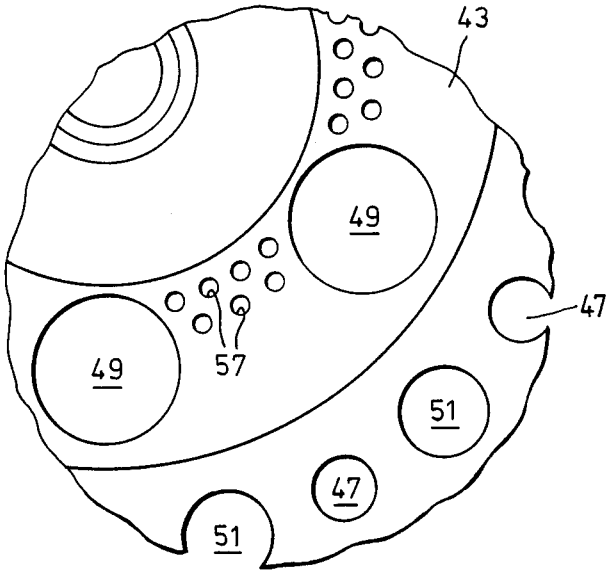

COMBUSTOR FOR GAS TURBINE ENGINE

BACKGROUND OF THE INVENTION

1. Field of the Invention
2. Description of the Related Art

This invention relates to combustors for gas turbine engines and particularly to multi-burner combustors. Such combustors for high efficiency turbines operate in onerous conditions, having to withstand gas exit temperatures in the region of 1200° C. It is therefore necessary to provide cooling means for the combustor which, while being effective, does not detract excessively from the performance of the combustion system.

It is also necessary to take account of different turbine loading conditions, between idling and full load, which make different demands on the combustor. The proportion of fuel to combustion air has to be varied greatly throughout the loading conditions and at very low loads a problem arises in trying to maintain stable combustion with very low fuel supply. The use of multiple burners in a single combustion chamber does offer a partial solution to this problem in that the fuel feed to some burners can be maintained at a reasonable level while other burners can be turned off completely.

This does, however, require more complex contol of the fuel feed system and is to be avoided if possible. This 'solution' does also produce greater non-uniformity of temperature distribution and consequent thermal stresses resulting in shorter operational life. If this 'staging' of the fuel supply is not employed, there are still advantages in a multi-burner arrangement, which could derive from its combination with other features:

(a) a multiplicity of fuel injection points spread across the upstream entrance to a flame tube, in combination with a uniform cooling of the flame tube walls, provides the possibility of good control of temperature distribution, and particularly turbine entry temperature distribution, resulting in longer operational life;

(b) a multi-burner arrangement combined with an unconventionally large proportion of compressed air admitted for primary combustion provides conditions leading to a significant reduction in emission of oxides of nitrogen;

(c) a multiplicity of fuel injection points uniformly distributed across the flame tube entrance provides an improved fuel/oxidant mixing geometry for inerts-laden, low heating value fuel.

Some attempt at control of the low fuel operating condition and maintenance of stable combustion has been made by feeding combustion air in jets through fairly large holes in the combustor wall and using gaps between successive concentric wall sections, as illustrated in FIG. 1 of the accompanying drawings, for the introduction of film cooling air. While this induced turbulence, in conjunction with the common use of a single fuel injector and primary air swirler, does facilitate the flame stabilisation function, there is a resultant loss of effective and uniform cooling of the combustor walls. The injection of penetrating air jets from the wall of the flame tube tends to cause disruption of any cooling film at the wall surface and consequent temperature variations. Thermal distortion and/or erosion results and the flame tube suffers a reduced life.

SUMMARY OF THE INVENTION

An object of the present invention is therefore to provide a multi-burner combustor which exhibits effective wall cooling combined with good flame stabilisation in all operating conditions in combination with improved combustion exit temperature distribution, reduced oxides of nitrogen emission, and improved combustion performance when burning low heating-value fuels.

According to the present invention, a combustor for a gas turbine engine comprises a flame tube, a plurality of fuel injectors each having a fuel discharge path with a radial component of direction, each having flame stabilisation means arranged in a plane transverse to the axis of the flame tube, means for directing compressed air axially around and past said injectors and flame stabilisation means, including an axial passage of atomising air directed through each fuel discharge path; means for directing compressed air in a generally radial inward direction into the flame tube through double walls having an annular space therebetween, both walls having multiple small holes out of radial alignment with each other to permit cooling of the inner wall by impingement of air from the holes in the outer wall and by effusion of air through the holes in the inner wall, the holes being arranged to produce minimal effect on the aerodynamic flow pattern established in the flame tube.

Each said fuel injector preferably comprises a nozzle having a closed end and a plurality of radially directed orifices, and a baffle plate through which the nozzle projects, the baffle plate having a ring of atomisation holes surrounding the nozzle in positions corresponding to but upstream of the orifices, the baffle plate being of shallow cup-shape opening towards the down stream end of the flame tube and forming a containment wall for the flame stabilisation region.

The baffle plates are preferably of such peripheral shape as to provide gaps between them of approximately constant width. In furtherance of this aim, a weir plate may be mounted between the wall of the flame tube and the plurality of baffle plates, the weir being contoured to provide a substantially uniform air supply passage around each of the outer baffle plates. The baffle plates are preferably hexagonal and arranged in a honeycomb formation.

The fuel injectors are preferably mounted in cantilever manner from a fuel manifold plate upstream of the flame tube, the fuel injectors and associated baffle plates in the mouth of the flame tube being thereby free to move under thermal influence.

Each fuel injector preferably comprises separate ducts for liquid and gaseous fuel, means being provided for selecting between the two fuels. Means for water injection may also be provided.

Adjacent ones of the baffle plates may be linked together by windshield strip members free to move relative to at least one of the linked baffle plates, the windshield strip members facilitating flame spread between adjacent fuel injectors and baffle plates.

The baffle plates may each incorporate a multiplicity of holes additional to the atomisation holes to permit further entry of air to the flame side of the baffle plate and thereby inhibit formation of carbon deposit and provide further aeration of the mixture.

The arrangement may be such that the proportion of air passing through the atomisation holes is preferably limited to 10% of the total air supplied to the combustor.

The arrangement may also be such that the proportion of air supplied to and between the baffle plates is between 70% and 90% of the total air supplied to the combustor, and the proportion of air supplied for cooling the flame tube is between 10% and 30% of the total air supplied to the combustor.

The total cross-sectional area of the holes in the inner wall of the flame tube is larger than that of the holes in the outer wall of the flame tube.

BRIEF DESCRIPTION OF THE DRAWINGS

A combustor for a gas turbine engine in accordance with the invention will now be described, by way of example, with reference to the accompanying drawings, of which:

FIG. 4 is an end elevation of a burner module on the same scale as FIG. 3, looking upstream;

FIG. 5 is an enlarged view of part of FIG. 4;

DETAILED DESCRIPTION OF THE PREFERRED EMBODIMENTS

Figure 1:
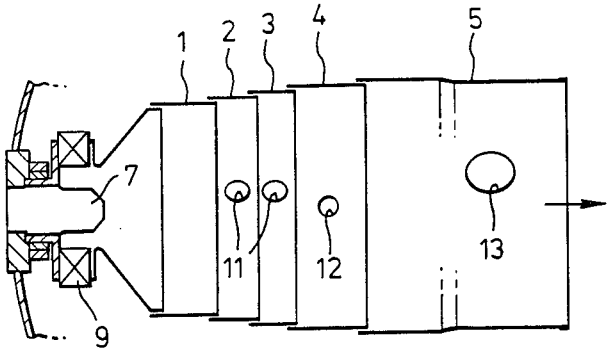
FIG. 1 is a cross section of a conventional tubular combustor employing a single fuel injector and sectionalised flame tube as referred to above; in accordance with the Prior Art

Referring now to FIG. 1 of the drawings, this shows a conventional combustor in which the tube comprises a series of concentric cylinders 1 to 5 arranged with a narrow slot between successive ones to provide a film of air to cool the walls. A single fuel injector 7 atomises the fuel and a surrounding primary air swirler 9 imparts turbulence to air entering radially. Secondary combustion air is injected into the flame tube by way of relatively large holes 11 in the flame tube cylinders 2 and 3 and this in combination with the primary swirler efflux provides turbulence in the flow of combustion mixture. Further holes 12 and 13 in the cylinders 4 and 5 provide for entry of intermediate and dilution air to induce complete combustion of fuel and allow a reduction in mean gas temperature to a level acceptable to the turbine. These various air jets entering the flame tube transversely do, as mentioned above, upset the cooling film and cause thermal distortion. This is exacerbated by the necessarily large pressure drop across the tube wall.

Figure 2:
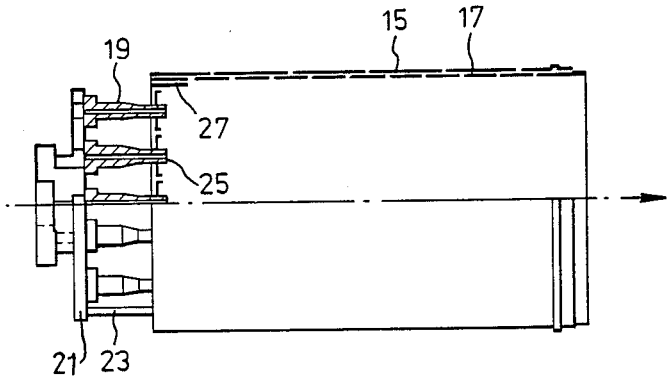
FIG. 2 is a part sectional elevation of a multi-burner combustor in accordance with the invention.

FIG. 2 in contrast, shows a combustor embodying the invention. The flame tube comprises an outer wall 15 radially spaced from an inner wall 17, the walls being single, uniform, concentric cylinders, each having holes as described in relation to FIG. 7. The flame tube is therefore easier to fabricate than that of the conventional combustor.

An array of nineteen fuel injectors 19 is mounted on a fuel manifold plate 21. In another embodiment (not shown) the injectors are mounted on another rigid support member. Bolts 23 support a weir plate (shown in FIG. 6) which in turn is bolted onto a flange (not shown) on the flame tube mouth. The fuel injector nozzles 25 are arranged to be in a transverse plane just inside the flame tube mouth.

One short cylinder 27 provides a guide gap for starting the wall cooling film, this cylinder also being mounted in the mouth of the flame tube.

Figure 3:
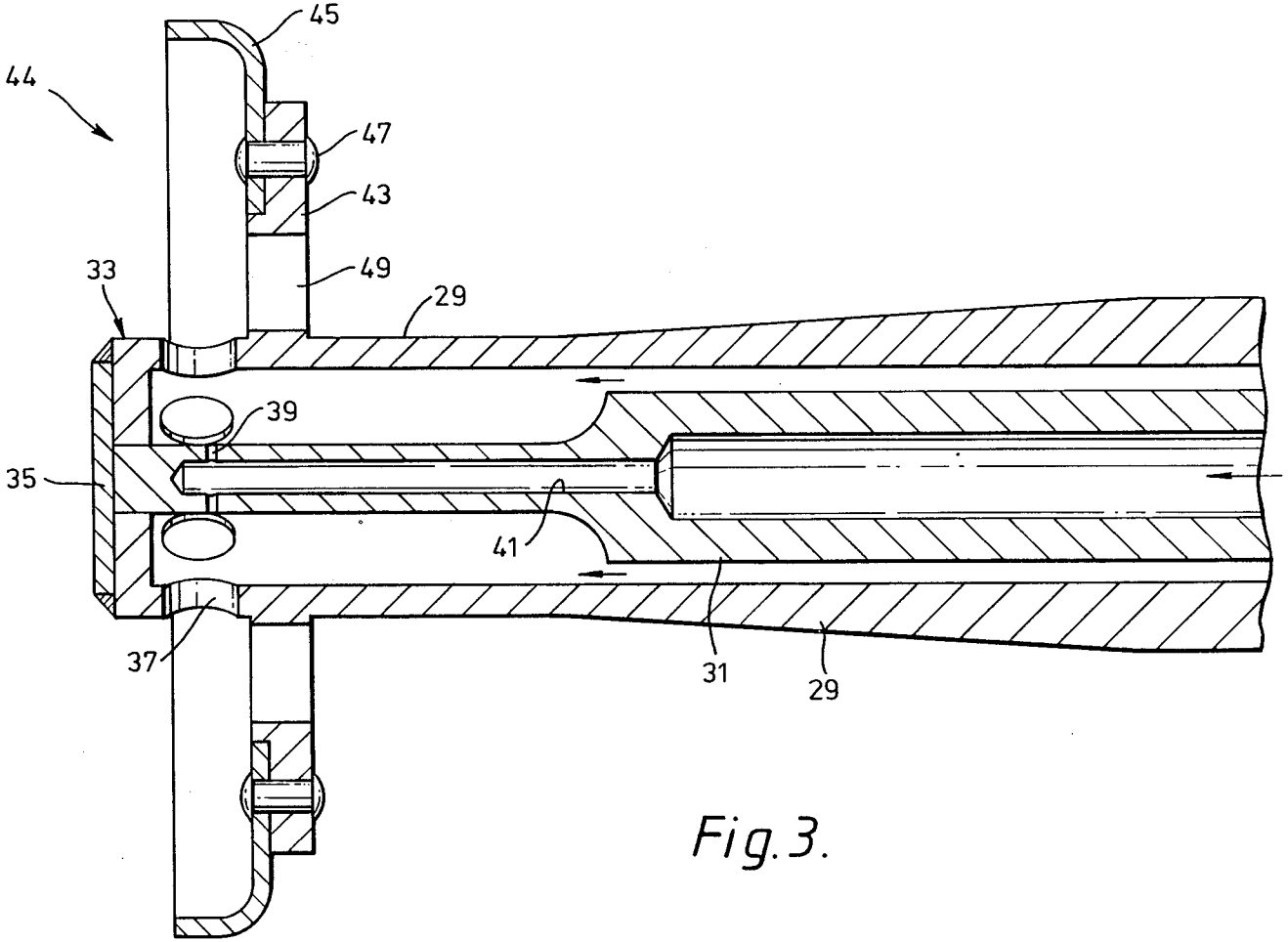
FIG. 3 is a sectional elevation of part of a fuel injector and baffle on a larger scale than FIG. 2.

FIG. 3 which is twice full size shows part of one fuel injector in detail. It comprises a tubular body 29 enclosing a liquid fuel core tube 31. Liquid fuel (oil) is supplied along the centre of the core tube 31 and gaseous fuel along the annulus between the tubes. Valves (not shown) control the selection of gas or oil fuel.

The nozzle end 33 is closed off and covered by a disc 35 of refractory metal acting as a heat shield. Six radially directed orifices 37 adjacent the end of the nozzle provide an exit for fuel under pressure. Six further holes 39 in the core tube 31 are aligned with the orifices 37 in the body wall 29. When oil is selected, it passes along the central core 41, through the holes 39, through the annular gap as a jet and radially out through the orifices 37.

Mounted on the fuel injector body, just upstream of the orifices 37, is a baffle plate 44 of shallow cup shape, the 'cup' opening towards the downstream direction (to the left in FIG. 3 and the right in FIG. 2). This baffle plate is of hexagonal shape viewed 'end-on', as shown in FIG. 4. In this particular embodiment the plate is formed in two parts, a circular flange 43 integral with the injector body 29 and a hexagonal annulus 45 fixed to the flange by rivets 47.

There are six axial holes 49 in the flange 43, close to the body 29 and in alignment with the radial fuel orifices 37. These axial holes 49 provide jets of atomising air to intercept the radial jets of fuel from orifices 37. Since liquid fuel atomisation is achieved by liquid/air jet interaction, the supplied fuel pressure requirement is significantly less than that required for a conventional swirl-jet pressure atomiser.

In a modification of this embodiment the complete baffle plate 44 is formed in one piece and is welded or otherwise rigidly secured to the injector body 29.

The fuel injector is mounted in cantilever manner at its rear end from the fuel manifold plate 21.

FIG. 4 shows the downstream face of the fuel injector of FIG. 3, i.e., looking into the cup-shaped baffle plate 44.

In addition to the axial atomisation holes 49 there are a number of other air holes in the baffle plate 44. A ring of holes 51 approximately half the size of the atomising holes 49 lie on the same diameter as the rivets 47. A further six holes 53 of this same size lie in the 'corners' of the hexagon and a further forty-eight small holes 55 lie on a hexagon within the periphery of the baffle plate.

FIG. 5 shows a part of the baffle plate 44 to a larger scale and particularly two further rings of small holes 57 not shown in FIG. 4.

The various holes 51, 53, 55 and 57 provide aeration of the fuel in the region of the baffle plate and also inhibit deposition of partly burnt carbon on the face of the baffle plate.

Figure 6:
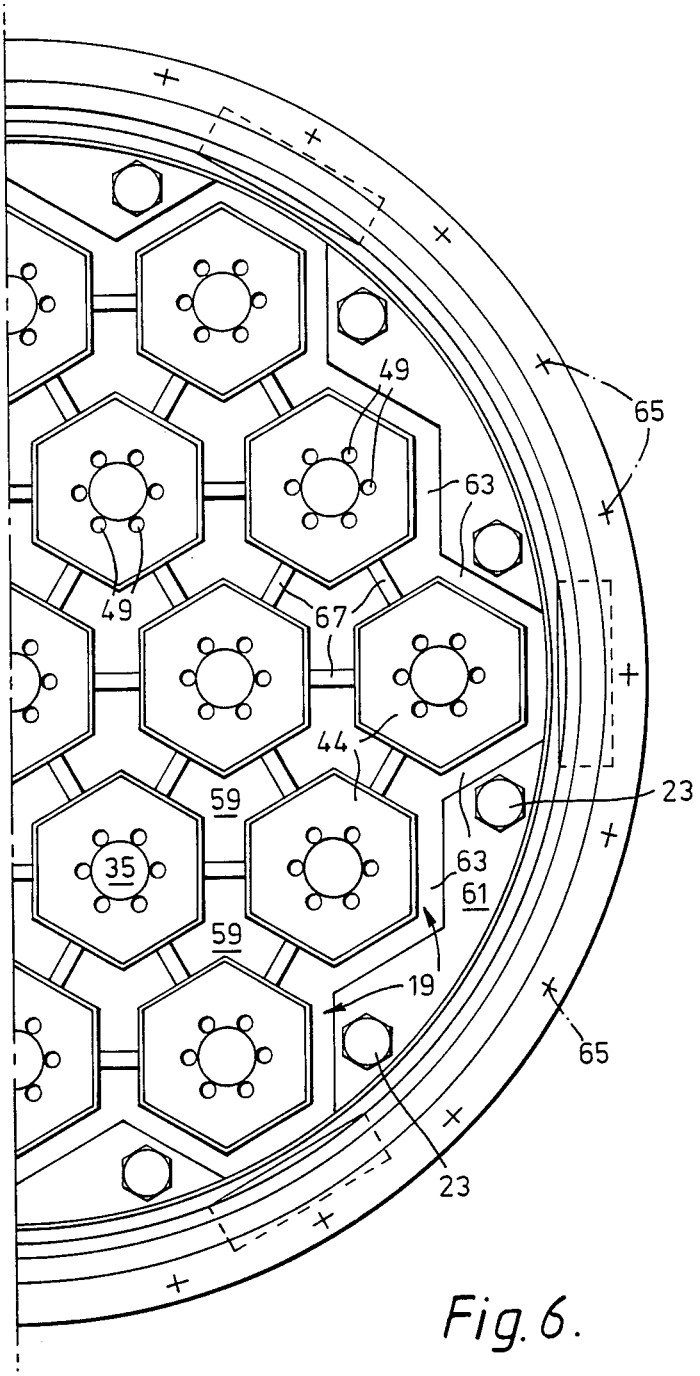
FIG. 6 is an end elevation of one half of the combustor showing half of the nineteen fuel injectors and baffles making up the total array.

FIG. 6 shows (half of) a view of the combustor looking upstream into the faces of the burner modules 19. These are arranged in a honeycomb fashion with uniform and substantial gaps 59 between adjacent baffle plates for the passage of combustion air, whereby the quantity and the flow path of primary air admission completely surrounding each baffle periphery is uniform, and known or calculable in relation to compressor output and fuel flow rates.

In order to maintain a uniform passage for the flow of air around each injector and baffle plate even at the edges of the array, a weir plate 61 is mounted in the same plane as the baffle plates 44 to close off some of the otherwise irregular gap that would arise between the peripheral baffle plates and the wall of the flame tube. The weir plate 61 is of such shape and size as to leave a gap 63 of approximately half the width of that between adjacent baffle plates to allow for the reduced air demand on one side of the gap. Every baffle plate is thus provided with a uniform surrounding air passage.

The weir plate is carried on bolts 23 which extend the length of the injectors and are fixed in the fuel manifold plate 21. The weir plate itself is bolted on to a flange on the mouth of the flame tube at centres 65. In order that the air passage shall be uniform around the whole periphery of the outer baffle plates, the weir plate 61 is upturned at its edge towards the downstream side, as shown in section in FIG. 7. The weir plate may be cooled by providing small holes.

A particular feature of this embodiment is the structure provided for inducing flame spread between the baffle plates. A strip of metal 67, a windshield strip, extends between each pair of opposed edges of adjacent baffle plates in the plane of the baffle plate mouth. This strip 67 is welded at one end to a baffle plate but free to move relatively to the opposed baffle plate. In operation a low pressure region is created on the downstream side of this strip which thus induces a flame to travel across the 'bridge' as it were, to strike the next burner flame. An important feature of this structure is the absence of any thermal force exerted by the strip between the linked baffle plates. The baffle plates are therefore free to 'float' on their cantilever mountings.

It would be possible to mount the strips so that they were trapped but not rigidly connected at either end, for example by inserting the strip end in a slot in the wall of the baffle plate and twisting it inside the wall.

In a further embodiment (not shown) the baffles are not rigidly attached to the injectors, but a baffle array is constructed as an integral disc, individual baffles being attached to each other by the windshield strips, and connected to the flame tube, possibly via the weir-plate by any suitable means permitting limited freedom to move under thermal influence, e.g. protrusions sliding in oversize slots. Central holes in each baffle admit the injector nozzles with sufficient clearance to allow thermally-caused movement. An advantage of this embodiment is that it allows easy withdrawal of the injectors for periodic cleaning or replacement.

Figure 7:
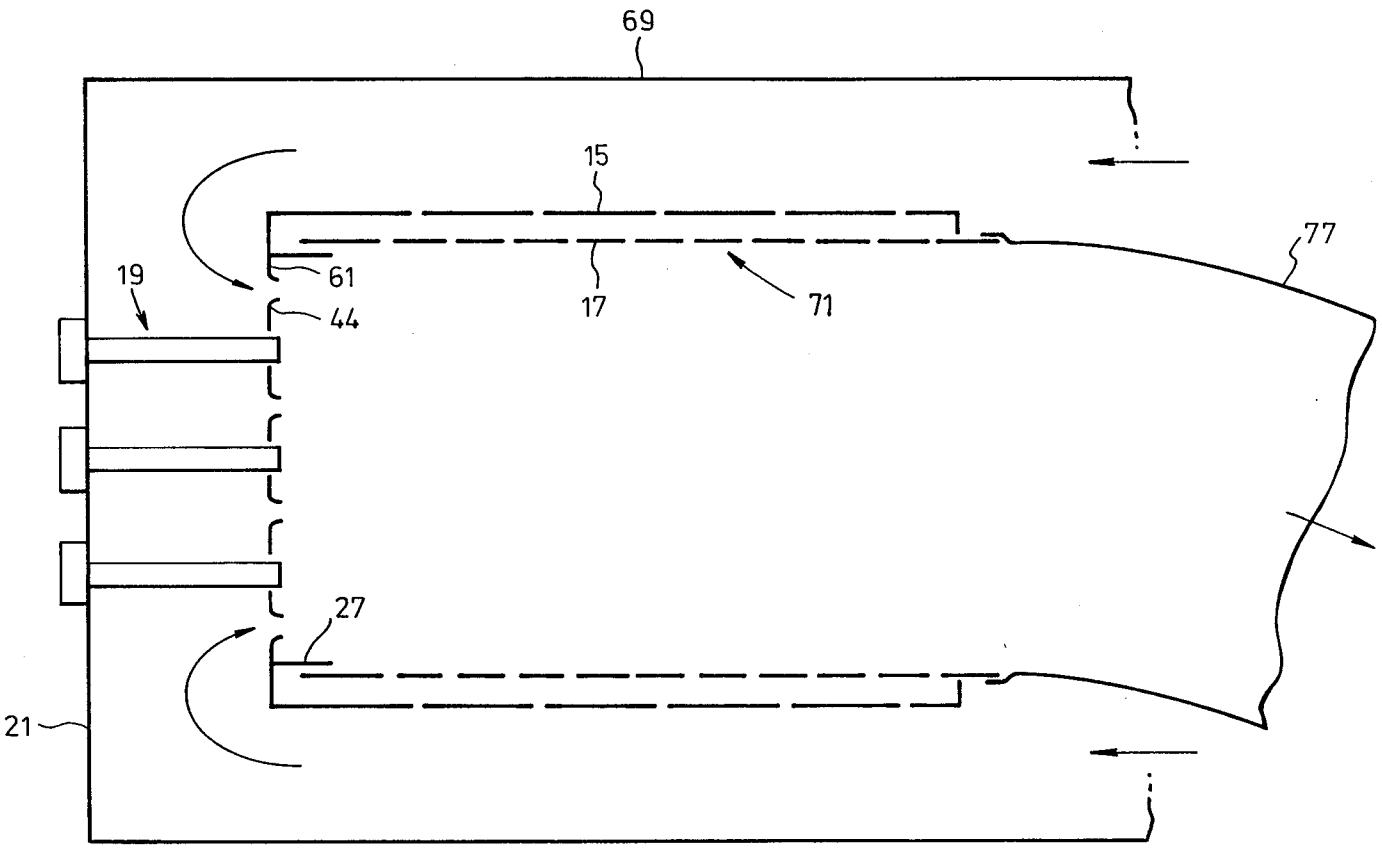
FIG. 7 is a diagrammatic sectional elevation of a three-burner combustor showing the outlet duct and the outer air casing of the combustor.

Referring now to FIG. 7 this shows, in outline, a three-burner combustor, i.e. for a smaller engine than the combustor of the previous figures. The fuel injector 29 and baffle plate 44 are mounted as before on the fuel manifold 21. This plate 21 is bolted to a flange on the combustor cylindrical casing 69 which encloses the flame tube 71, of similar, double-walled, construction to that of the combustor of the previous figures.

The baffle plates 44 and weir plate 61 are mounted as before, providing a primary air supply through and around the baffle plates 44. Combustion air is supplied by a compressor (not shown), the air passing into and along the outer casing 69 and then reversing direction to pass into the flame tube.

The flame tube 71 has an outer wall 15 having a large number of small holes covering its surface. A separate inner wall 17 of the flame tube has a greater number of holes with a cross-sectional-area ratio of about four to one, inner to outer, in this embodiment. There is therefore a very much greater pressure drop across the outer wall 15 than across the inner wall 17. This is desirable since the outer, cooler, wall is more capable of sustaining the greater pressure. In addition, the materials used for the two walls can be made to suit their different operating conditions, the outer wall to withstand pressure stress and the inner wall thermal stress. The wall cooling is explained further in relation to FIG. 8. It should be noted that both Figures show for clarity the small holes much larger than scale size. The interwall annulus is also exaggerated, a typical gap being 3 times an impingement hole diameter. The two walls are rigidly connected to each other only at their upstream ends, their downstream ends having a limited relative freedom to permit thermally-caused movement.

In a further embodiment, (not shown), the substantial uniform annular space between inner and outer walls is divided in axial and/or circumferential directions into differential cooling zones, subject to greater or lesser applied cooling air pressure. Interwall partitions are provided without compromising the relative freedom of the walls, by securing the partitions to one wall only, and providing a clearance between partition tips and opposing lands on the opposite wall.

A transition duct 77 is connected to the flame tube 71 by a freely expanding telescopic joint, the transition duct being a single walled duct without cooling holes. Alternatively, duct 77 may be cooled conventionally, or by a perforated double-walled arrangement similar to flame tube walls 15 and 17.

A cooling ring 27 initiates the cooling film on which the inner wall 17 relies.

Figure 8:
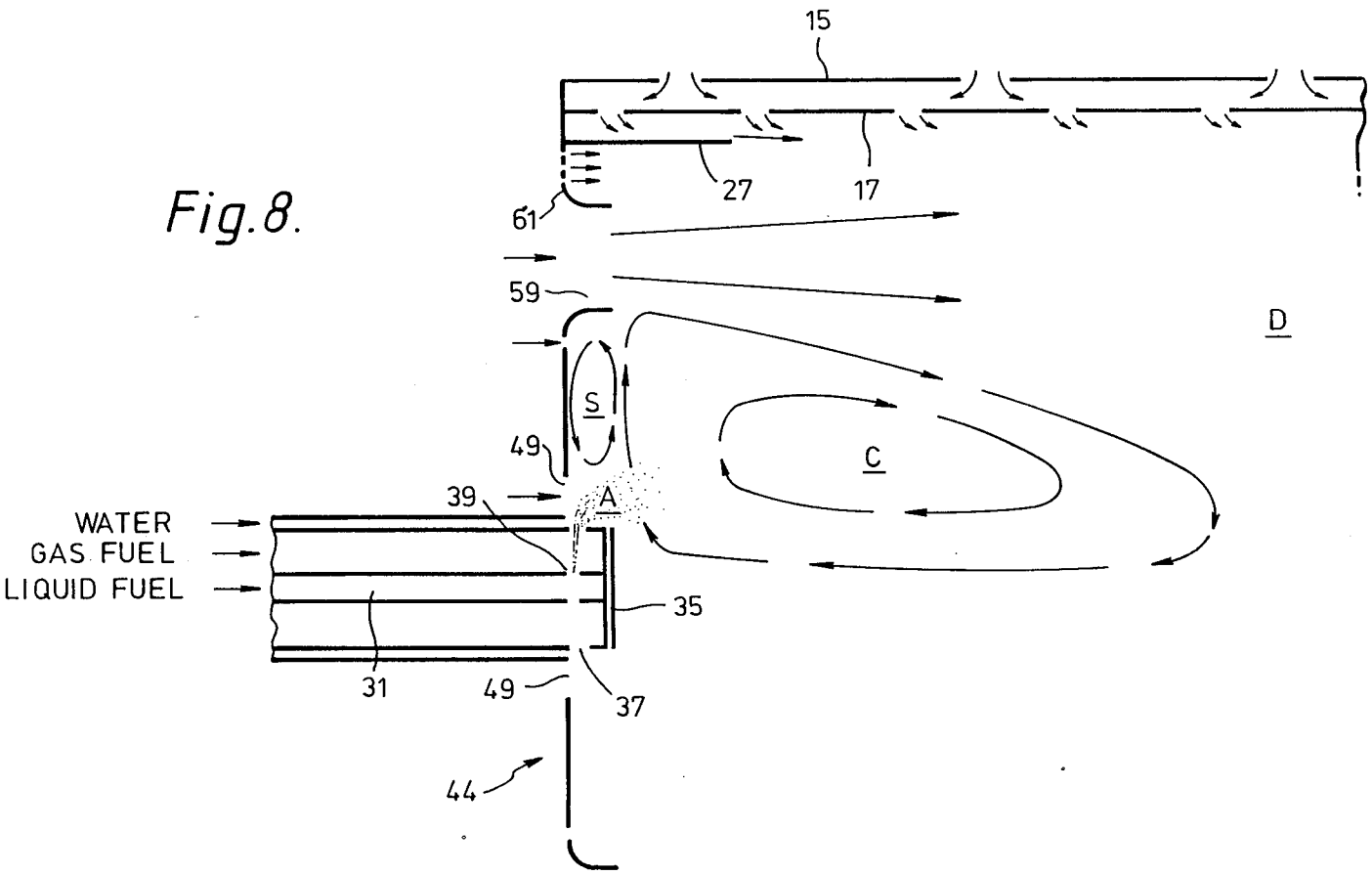
FIG. 8 is a diagrammatic sectional view of a fuel injector nozzle in the mouth of the flame tube and showing the flow paths of the fuel/air components of the combustion mixture.

FIG. 8 shows in more detail a diagrammatic section of the combustor, in the region of an outer burner 19 (or any of the three in the case of FIG. 7), together with the flow patterns arising in the combustion mixture.

In a particular operational example the flow patterns illustrated are obtained. Liquid fuel is supplied in the core tube 31 of the fuel injector and issues as a radial jet from hole 37. Only one of the six actual jets is shown for simplicity. The jet emanates from the outer orifice 37 and is immediately atomised by an axial jet of air from hole 49 in the baffle plate 44 and ignited by means not shown. This occurs in the fuel atomising region 'A'. Water may be injected by further ducts in the injector.

The atomised fuel/air mixture then follows divided paths, one path turning anti-clockwise, as seen in this Figure, back towards the baffle plate and encircling a region 'S' referred to as a flame stabilisation region constrained within the cup shape of the baffle. The other path turns clockwise into the downstream direction and circulates about a relatively large region 'C', the main combustion region. The air supply for this main combustion region comes largely from the gap 59 around the baffle plate 44. Completion of the combustion process, and dilution of the hot gases by convective mixing then occurs in region 'D' the dilution region. There is no separate dilution air supply fed to the dilution region.

It will be clear that the flow patterns are symmetrical about the axis of the fuel injector since the radial fuel jets are uniformly spaced around the injector and the air flow through and around the baffle plates has been made uniform by means of the gaps 59. Reference to 'clockwise' and 'anticlockwise' will therefore be interpreted accordingly.

Cooling of the flame tube is effected as shown in FIGS. 7 and 8. The outer wall 15 is substantially covered with a fairly large number of small holes therethrough which produce a relatively large pressure drop, and jets of cooling air impinging upon and cooling the inner wall 17. The latter has a greater number of holes with a total hole area about four times that of the outer wall in this embodiment. The pressure drop across the inner wall is thus about sixteen times less than that across the outer wall. Different sizes of holes may be employed, as well as different numbers to achieve the desired total cross-sectional hole area. The holes in the inner and outer walls respectively are located so that they are not in radial alignment with each other and so that impingement action on the outer surface of the inner wall provides forced convective cooling. With the low pressure drop across the inner wall and small holes in it, effusion cooling takes place. The cooling air, emerging through the inner wall at low velocity, adheres to the inner surface and is entrained in a downstream direction by the flow of hot working gas to provide a continuous cooling film. The ring 27 is a short cylinder spaced from the inner wall within the mouth of the flame tube. It initiates the flow of this cooling film.

In an alternative embodiment (not shown), the first upstream effusion holes in wall 17 are omitted, and a starting cooling film is obtained from the main axial air feed by holes in the weirplate.

In either case the cooling air passing through the double wall of the flame tube has negligible effect on the flow pattern of the combustion mixture in the flame tube. One significant beneficial effect of this full-coverage impingement and effusion cooling method is that the temperature distribution of the flame tube is maintained much more nearly uniform. However, the transverse jets of air through the flame tube walls previously used for primary combustion purposes also had a function in providing a degree of flame stabilisation. With the use of continuous film cooling this facility is sacrificed but it is found that by supplying atomising air axially through multiple radial fuel jets downstream of baffles as described above, a flame stabilisation region (S) is formed which permits a large range of fuel/air ratios down to a very weak mix, for use in idling at no load for example.

In addition, it is found that the mixing and dilution previously achieved by transverse or tangential air jets is, in the described embodiments, obtained by the uniform distribution of air supply over the array of baffle plates, the air entering the mouth of the flame tube axially, through the gaps 59 between baffle plates and through the anti-carbon aeration and atomising holes.

The invention enables very high firing temperatures to be achieved. The combination of features as described allows the fuel to 'see' more oxygen than in conventional designs. An incidental advantage, particularly with gaseous fuels, is that it may be possible to utilise a flame tube of axial length shorter than in conventional designs. The invention is expected to be especially suitable for low-BTU gaseous fuels.

The invention provides a significant reduction in the quantity of air needed for cooling and thus more air is available in the axial path for dilution, reduction of oxides of nitrogen, and for temperature distribution control. Reduced emission of smoke has been obtained on tests.

In one particular operation of the embodiment of FIG. 8, the following distribution of air was found. The main proportion, 59%, passed through the gaps 59 between the baffle plates; 14% passed through the flame tube walls for impingement and effusion cooling; 9% through the anti-carbon and aeration holes 51, 53 and 55 in the baffle plates; 6% through the atomising holes 49; 0.9% from the film cooling gap provided by the cylinder 27; and 0.7% for effusion cooling of the weir plate 61. The residual quantity was used for effusion cooling of the transition duct 77 shown in FIG. 7.

These proportions may of course be varied to some extent without losing the advantages provided by the invention. The atomising air may be kept within an upper limit of 10%. The proportion of air passing through the gaps 59 between baffle plates may be kept within a range 50% to 80%, and the amount of air used for impingement/ effusion cooling of the flame tube walls may be kept to a maximum of 30%.

Throughout this specification and the appended claims, the word 'air' is used for convenience, air being the most commonly used oxidant, but it is intended to be interpreted as including any other gaseous oxidant, or coolant, as the context may require.

While in the above embodiments hexagonal baffle plates have been employed it should be noted that circular or other shaped baffle plates may provide comparable results even though the inter-baffle gaps will then not be entirely uniform.

I claim:

1. A combustor for a gas turbine engine, said combustor comprising:

(A) a flame tube for containing a burning fuel/air mixture, said flame tube having a flame tube axis and including:
  (i) outer and inner walls,
  (ii) an annular space between said walls,
  (iii) multiple holes in said outer wall of a size to permit impingement cooling of said inner wall,
  (iv) multiple holes in said inner wall of a size to permit effusion cooling of said inner wall, and
  (v) said holes in said inner wall being out of alignment with and more numerous than said holes in said outer wall;

(B) a plurality of fuel injectors mounted for discharging fuel into said flame tube, each of said fuel injectors having a fuel injector axis substantially parallel to said flame tube axis and each fuel injector including:
  (i) a fuel injector body having a plurality of fuel discharge orifices each having an orifice axis directed outwardly from said fuel injector axis,
  (ii) flame stabilization means including a cup-shaped baffle plate comprising a plate mounted and disposed upstream of said fuel discharge orifices and a peripheral lip providing the cup-shape, said fuel injector body projecting through said baffle plate and said baffle plate having a ring of atomization holes surrounding said fuel injector body, each, of said atomization holes having a flow axis parallel to said fuel injector axis, and said flow axis intersecting a respective said orifice axis,
  (iii) said cup-shaped baffle plate opening toward a downstream end of the flame tube and forming a containment wall for a flame stabilization region;

(C) the baffle plates lying in a common plane transverse to said flame tube axis and separated by combustion air apertures; and (D) means for supplying air to the combustor, including:

(i) means for supplying compressed cooling air along a first path into said flame tube, said first path passing through said outer wall, through said inner wall and into said flame tube, (ii) means for supplying compressed air along second path into said flame tube, said second path passing through said apertures between said baffle plates and axially through said atomization holes to intercept said orifice axes, and (iii) said first and second paths having resistances to the flow of air, which resistances are in a relation such that between 70% and 90% of the total air supplied to the combustor takes said second path and the remaining proportion takes said first path.

2. A combustor according to claim 1, and comprising a weir plate mounted between the wall of the flame tube and said baffle plates, said baffle plates and said weir plate being of such peripheral shape as to provide a uniform air supply passage around each baffle plate.

3. A combustor according to claim 2, wherein said baffle plates are hexagonal and are arranged in honeycomb formation.

4. A combustor according to claim 1 and comprising a rigid support member upstream of the flame tube, said fuel injectors being mounted on said rigid support member in cantilever fashion and said baffle plates being carried by their respective fuel injectors, said fuel injectors and their respective baffle plates being free to move under thermal influence.

5. A combustor according to claim 4, and comprising a plurality of windshield strip members, each of said strip members linking a pair of adjacent baffle plates and being loosely attached to at least one of the pair to permit relative thermal movement and to facilitate flame spread between adjacent fuel injectors.

6. A combustor according to claim 1, wherein said baffle plates each incorporate a multiplicity of holes additional to said atomization holes to permit further passage of compressed air to the flame side of the respective baffle plate.

7. A combustor according to claim 2, wherein said baffle plates are linked together by fixed windshield strips facilitating flame spread between adjacent baffle plates, and comprising means attaching the baffle plates to said weir plate with limited freedom to move under thermal influence, said baffle plates each having a central hole to accommodate a respective fuel injector with sufficient clearance to allow thermal movement.

8. A combustor according to claim 1 wherein the total cross-sectional area of said holes in the inner wall of the flame tube is larger than that of the holes in the outer wall of the flame tube.

9. A combustor according to claim 1 wherein said inner and outer walls are rigidly connected together at their upstream ends only.

10. A combustor according to claim 1 and comprising a plurality of interwall partitions positioned between said inner and outer walls of the flame tube for dividing said annular space into differential cooling zones, said partitions being rigidly secured to one of said walls and having a clearance from the other of said walls.

11. A combustor according to claim 10 wherein said partitions are arranged axially.

12. A combustor according to claim 10 wherein said partitions are arranged circumferentially.

13. A combustor according to claim 1, and further comprising a transition duct connected to the downstream end of said flame tube for conducting the exhaust gases to the turbines, said transition duct having inner and outer walls and non-aligned cooling holes in both walls.

14. A combustor according to claim 12 wherein said partitions are arranged circumferentially.

15. A combustor for a gas turbine engine, said combustor comprising:

(A) a flame tube for containing a burning fuel/air mixture, said flame tube having a flame tube axis and including:

(i) outer and inner walls, (ii) an annular space between said walls, (iii) multiple holes in said outer wall of a size to permit impingement cooling of said inner wall, (iv) multiple holes in said inner wall of a size to permit effusion cooling of said inner wall, and (v) said holes in said inner wall being out of alignment with and more numerous than said holes in said outer wall;

(B) means for supplying compressed cooling air along a first path into said first tube, said first path passing through said outer wall, through said inner wall and into said flame tube;

(C) a plurality of fuel injectors mounted for discharging fuel into said flame tube, each of said fuel injectors having a fuel injector axis substantially parallel to said flame tube axis and each fuel injector including:

(i) a fuel injector body having a plurality of fuel discharge orifices each having an orifice axis directed outwardly from said fuel injector axis, (ii) flame stabilization means including a cup-shaped baffle plate comprising a plate mounted and disposed upstream of said fuel discharge orifices and a peripheral lip providing the cup-shape, said fuel injector body projecting through said baffle plate, and said baffle plate having a ring of atomization holes surrounding said fuel injector body, each of said atomization holes having a flow axis parallel to said fuel injector axis, and said flow axis intersecting a respective said orifice axis, and (iii) said cup-shaped baffle plate opening toward a downstream end of the flame tube and forming a containment wall for a flame stabilization region;

(D) means for supplying compressed air along a second path into said flame tube, said second path passing through said baffle plates and axially through said atomization holes to intercept said orifice axes;

(E) said first and second paths having resistances to the flow of air, which resistances are in a relation such that between 70% and 90% of the total air supplied to the combustor takes said second path and the remaining proportion takes said first path; and (F) means for positioning each baffle plate relative to said fuel discharge orifices to produce the flame stabilization region having a fuel/air mixture circulating in one direction adjacent the baffle plate, and to produce a main combustion region having a fuel/air mixture circulating in an opposite direction downstream of the flame stabilization region.

* * * * *